US010718160B2

(12) United States Patent
Leng

(10) Patent No.: US 10,718,160 B2
(45) Date of Patent: Jul. 21, 2020

(54) SWITCHABLE LADDER

(71) Applicant: NEW-TEC INTEGRATION (XIAMEN) CO., LTD., Xiamen, Fujian (CN)

(72) Inventor: Luhao Leng, Fujian (CN)

(73) Assignee: NEW-TEC INTEGRATION (XIAMEN) CO., LTD., Xiamen (CN)

( * ) Notice: Subject to any disclaimer, the term of this patent is extended or adjusted under 35 U.S.C. 154(b) by 83 days.

(21) Appl. No.: 15/906,770

(22) Filed: Feb. 27, 2018

(65) Prior Publication Data

US 2018/0252037 A1 Sep. 6, 2018

(30) Foreign Application Priority Data

Mar. 3, 2017 (CN) ..... 2017 1 0123548

(51) Int. Cl.
*E06C 1/32* (2006.01)
*E06C 1/10* (2006.01)

(52) U.S. Cl.
CPC . *E06C 1/32* (2013.01); *E06C 1/10* (2013.01)

(58) Field of Classification Search
CPC ..... E06C 1/00; E06C 1/08; E06C 1/10; E06C 1/14; E06C 1/32
See application file for complete search history.

(56) References Cited

U.S. PATENT DOCUMENTS 130,549 A * 8/1872 Valley ..... E06C 1/32 182/24
229,552 A * 7/1880 Phelps ..... E06C 1/32 182/24
493,977 A * 3/1893 Childs ..... E06C 1/32 182/24
734,147 A * 7/1903 Wagner ..... E06C 1/18 182/24
1,100,823 A * 6/1914 Gordon ..... E06C 1/32 182/24

(Continued)

FOREIGN PATENT DOCUMENTS

CN 2339739 Y 9/1999
CN 2632283 Y 8/2004
CN 206707597 U 12/2017

*Primary Examiner* — Katherine W Mitchell
*Assistant Examiner* — Shiref M Mekhaeil
(74) *Attorney, Agent, or Firm* — Cooper Legal Group, LLC

(57) ABSTRACT

Disclosed is a deformable herringbone ladder with straight ladder function, comprising a left ladder rack, a right ladder rack and a hinge mechanism, the left ladder rack and the right ladder rack are relatively rotatable to switch the ladder between a herringbone ladder state and a straight ladder state; wherein the left ladder rack comprises two left legs and an even number of left footboards connecting the two left legs, the left footboards are parallel arranged in equal spacing, the distance between two adjacent left footboards is defined L1; the distance between two adjacent right footboards is defined L2; in the straight ladder state by rotating, the distance between the left footboard at the top portion of the left ladder rack and the right footboard at the top portion of the right ladder rack is defined L3; L1=L2=L3. The present invention conforms the Europe and America's safety technical standard.

17 Claims, 7 Drawing Sheets

(56) References Cited

U.S. PATENT DOCUMENTS 1,374,548 A * 4/1921 Boyd ..... E06C 1/32 182/24
1,894,489 A * 1/1933 Jun ..... E06C 1/32 182/23
1,935,349 A * 11/1933 Breslow ..... E06C 1/32 182/22
1,936,508 A * 11/1933 Hanly ..... E06C 1/32 182/24
1,944,792 A * 1/1934 House ..... E06C 1/32 182/24
2,144,440 A * 1/1939 Gaffers ..... E06C 1/18 182/105
2,589,079 A * 3/1952 Heaivilin ..... E06C 1/32 182/26
2,647,676 A * 8/1953 Napiecinski ..... E06C 1/32 182/25
2,864,544 A * 12/1958 Scheidegger ..... A01D 46/243 182/22
2,896,830 A * 7/1959 Bair ..... E06C 1/32 182/26
3,129,785 A * 4/1964 Keith ..... E06C 1/18 182/24
3,692,143 A * 9/1972 Kummerlin ..... E06C 1/12 182/24
3,785,455 A * 1/1974 Waldron ..... E06C 1/32 182/22
3,866,714 A * 2/1975 Waldron ..... E06C 1/18 182/22
3,912,043 A * 10/1975 Brannan ..... E06C 1/32 182/23
3,955,240 A * 5/1976 Schuh ..... E05D 11/1007 16/326
4,210,224 A * 7/1980 Kummerlin ..... E06C 1/12 182/166
4,216,844 A * 8/1980 Klafs ..... E05D 11/1007 16/329
4,376,470 A * 3/1983 Ashton ..... E06C 1/22 182/207
4,407,045 A * 10/1983 Boothe ..... E05D 11/1007 16/327
4,540,306 A * 9/1985 Wang ..... E06C 1/32 16/332
4,566,150 A * 1/1986 Boothe ..... E05D 11/1007 16/332
4,577,986 A * 3/1986 Wang ..... E06C 1/32 16/325
4,666,328 A * 5/1987 Ryu ..... E06C 1/32 16/329
4,697,305 A * 10/1987 Boothe ..... E06C 1/32 16/329
4,719,990 A * 1/1988 Markovic ..... E06C 7/44 182/163
4,770,559 A * 9/1988 Yoo ..... E06C 1/32 182/163
4,890,950 A * 1/1990 Yoo ..... E06C 1/32 16/328
4,951,780 A * 8/1990 Kim ..... E04G 1/30 182/119
5,022,118 A * 6/1991 Wan-Li ..... E06C 1/32 16/327
5,366,051 A * 11/1994 Bartnicki ..... E06C 1/393 182/124
5,954,157 A * 9/1999 Grimes ..... E06C 1/12 16/329
6,115,886 A * 9/2000 Fujita ..... G06F 1/1616 16/330
6,220,389 B1 * 4/2001 Krause ..... E06C 1/12 182/163
6,343,406 B1 * 2/2002 Yeh ..... E05D 11/1007 16/328
6,711,780 B2 * 3/2004 Lee ..... E06C 1/32 16/326
6,857,503 B2 * 2/2005 Simpson ..... E06C 1/18 182/178.3
7,047,597 B2 * 5/2006 Lee ..... E06C 1/32 16/233
7,140,072 B2 * 11/2006 Leng ..... E06C 1/32 16/326
D553,757 S * 10/2007 Moss ..... D25/68
7,364,017 B2 * 4/2008 Moss ..... E06C 1/22 182/163
7,424,933 B2 * 9/2008 Weiss ..... E06C 1/32 16/328
8,591,444 B2 * 11/2013 Bejarano ..... A61F 5/0125 602/16
D767,784 S * 9/2016 Kieffer ..... D25/68
9,580,959 B2 * 2/2017 Kieffer ..... E06C 1/383
10,233,692 B2 * 3/2019 Kieffer ..... E06C 1/32
2003/0127288 A1 * 7/2003 Ed ..... E06C 1/36 182/206
2003/0188923 A1 * 10/2003 Moss ..... E06C 1/32 182/23
2005/0166364 A1 * 8/2005 Lee ..... E05D 11/0054 16/324
2005/0268434 A1 * 12/2005 Burbrink ..... E06C 1/32 16/324
2008/0109994 A1 * 5/2008 Liao ..... B62B 3/12 16/319
2011/0024232 A1 * 2/2011 Leng ..... E06C 1/18 182/116
2014/0251729 A1 * 9/2014 Parker ..... E06C 1/18 182/129
2015/0315844 A1 * 11/2015 Miao ..... E06C 7/50 16/319
2016/0177625 A1 * 6/2016 Chang ..... E06C 1/18 182/104
2016/0348434 A1 * 12/2016 Williams ..... E06C 1/387
2017/0211283 A1 * 7/2017 Sommer ..... E04G 1/30
2017/0328131 A1 * 11/2017 Woodward ..... E06C 1/393

* cited by examiner

SWITCHABLE LADDER

TECHNICAL FIELD

The present invention relate to a herringbone ladder, particularly to a herringbone ladder which can be changed to be a straight ladder.

RELATED ART

Traditional herringbone ladder comprises a left ladder rack and a right ladder rack, the top end of the left ladder rack and the top end of the right ladder rack are rotatably hinged by a hinge. The left ladder rack and the right ladder rack are contacted together when the ladder is unused and folded. The left and right ladder rack are rotated and unfolded to form a herringbone shape to stand stably on the ground when the ladder is used.

To enrich the functions of the herringbone ladder, the traditional herringbone ladder is improved to make the left ladder rack and right ladder rack capable of rotating relatively in line to be served as a straight ladder. Therefore, the ladder has three states: the left ladder rack and the right ladder rack being folded, the left ladder rack and the right ladder rack being rotated to a herringbone ladder, the left ladder rack and the right ladder rack being rotated to a straight ladder.

But in the Europe and America's safety technical standard, a particular condition is required to the straight ladder that each step distance mush be equal. As the traditional herringbone ladder has the footboard at the top portion of the left ladder rack and the footboard at the top portion of the right ladder rack very close to each other (even overlapping) in the straight ladder state, the actual step distance of joint position of the left ladder rack and the right ladder rack is not equal to the normal step distance (the actual step distance is short, or the actual step distance is a thickness of the footboard shorter than the normal step distance, or the actual step distance is a thickness of the footboard longer than the normal step distance). Therefore, existing herringbone ladder with straight ladder function does not conform the the Europe and America's safety technical standard.

SUMMARY OF THE INVENTION

The present invention provides a deformable herringbone ladder with straight ladder function, which has an equal step distance either in straight ladder state or in herringbone ladder state. The technical solution of the present invention is that: A deformable herringbone ladder with straight ladder function, comprising a left ladder rack, a right ladder rack and a hinge mechanism, the top portion of the left ladder rack is connected to the top portion of the right ladder rack by the hinge mechanism, the left ladder rack and the right ladder rack are relatively rotatable to switch the ladder between a herringbone ladder state and a straight ladder state; the left ladder rack comprises two left legs and an even number of left footboards connecting the two left legs, the left footboards are parallel arranged in equal spacing, the distance between two adjacent left footboards is defined L1; the right ladder rack comprises two right legs and an odd number of right footboards connecting the two right legs, the right footboards are parallel arranged in equal spacing, the distance between two adjacent right footboards is defined L2; in the herringbone ladder state, the rotating center of the hinge mechanism is disposed between the left ladder rack and the right ladder rack, and the height of the rotating center of the hinge mechanism is disposed between the highest point and the lowest point of the footboard at the top portion of the herringbone ladder; in the straight ladder state by rotating, the left ladder rack is in line with the right ladder rack, the distance between the left footboard at the top portion of the left ladder rack and the right footboard at the top portion of the right ladder rack is defined L3; therein L1=L2=L3.

Compared to the existing known technology, the technical solution of the present invention has advantages as follows: The present invention has even left footboards and odd right footboards, the total number of the left and right footboards is odd; if the ladder is used as a straight ladder, the two ladder racks joint without coinciding footboards; the step distance (L1) between the left footboards, the step distance (L2) between the right footboards and the step distance (L3) between the left and right footboards are equal that conform the technical standard of safety.

BRIEF DESCRIPTION OF THE DRAWINGS

The present invention will be further described with the drawings and embodiments.

DETAILED DESCRIPTION OF THE EMBODIMENTS

Referring to FIGS. 1-4, the deformable herringbone ladder with straight ladder function of the present invention comprises a left ladder rack 10, a right ladder rack 20 and a hinge mechanism 30, the top portion of the left ladder rack 10 is connected to the top portion of the right ladder rack 20 by the hinge mechanism 30, the left ladder rack 10 and the right ladder rack 20 are relatively rotatable to switch the ladder between a herringbone ladder state and a straight ladder state.

Figure 6:
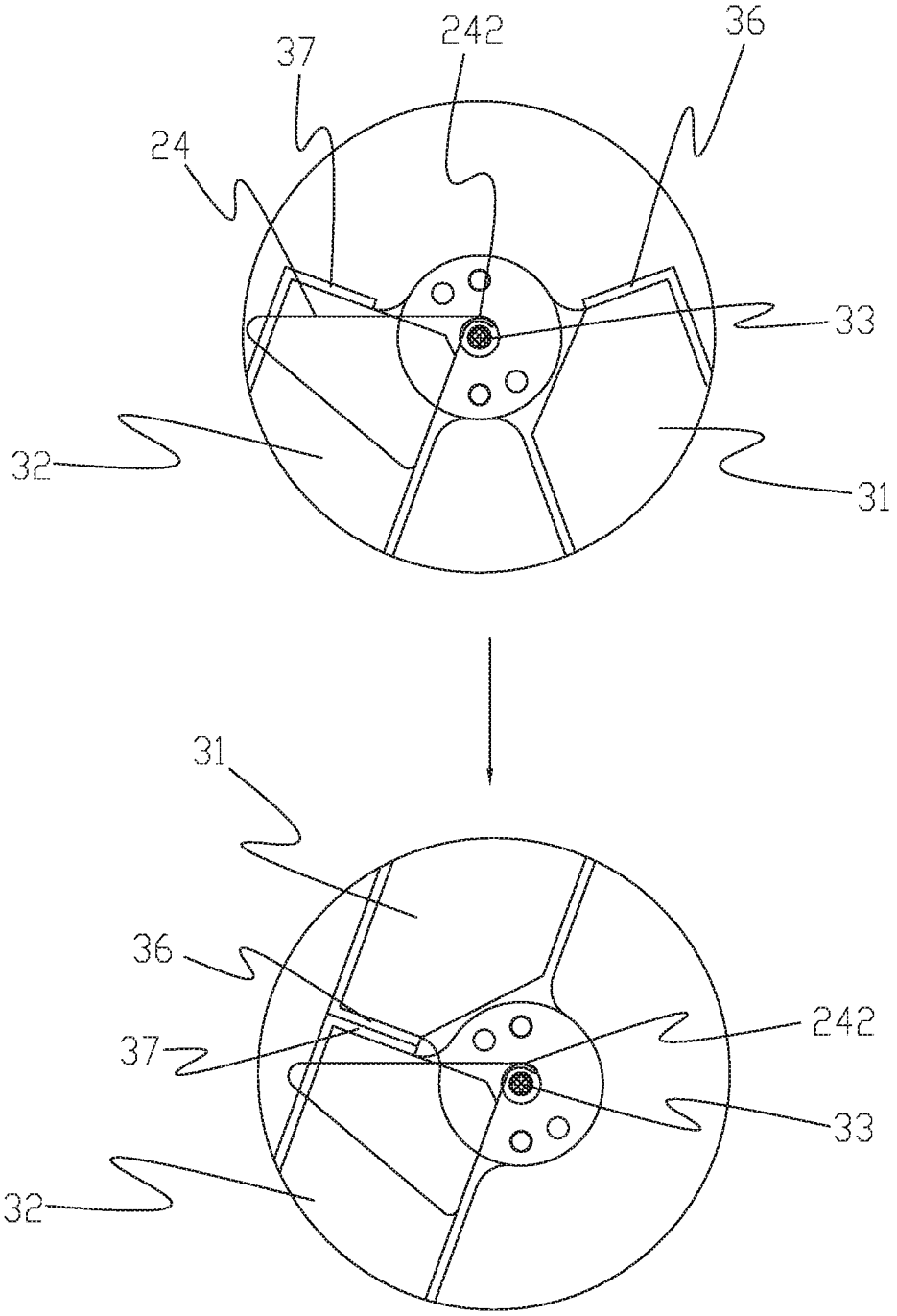
FIG. 6 illustrates a schematic diagram of the herringbone ladder of FIG. 1 rotating from the herringbone ladder state to the straight ladder state.
Figure 7:
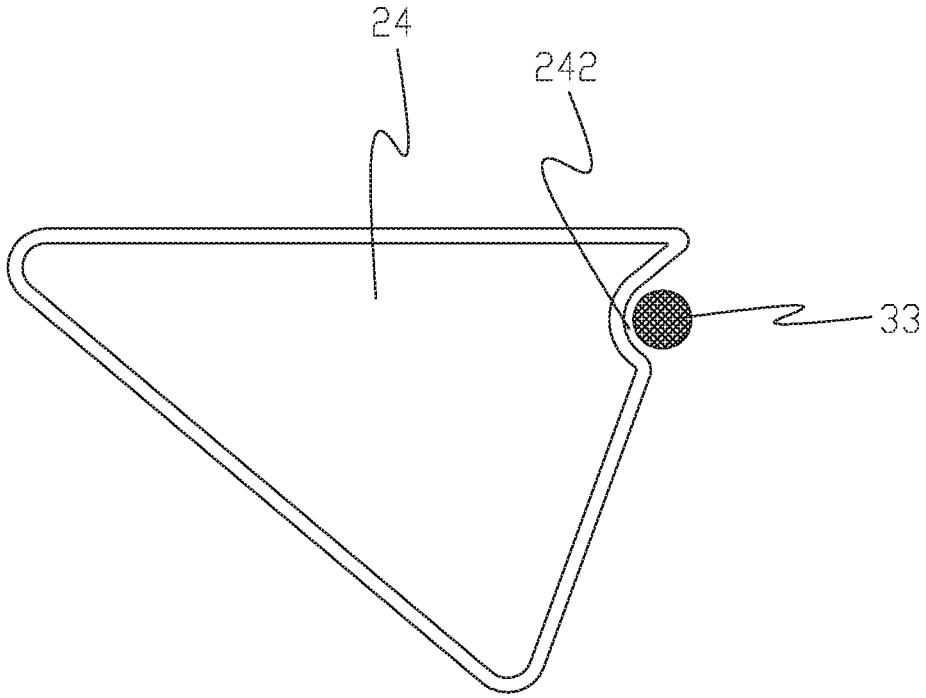
FIG. 7 illustrates a schematic diagram of the left footboard or the right footboard of the herringbone ladder of the present invention.

The left ladder rack 10 comprises two left legs 12 and an even number of left footboards 14 connecting the two left legs 12, the left footboards 14 are parallel arranged in equal spacing, the distance between two adjacent left footboards 14 is defined L1; the right ladder rack 20 comprises two right legs 22 and an odd number of right footboards 24 connecting the two right legs 22, the right footboards 24 are parallel arranged in equal spacing, the distance between two adjacent right footboards 24 is defined L2; in the herringbone ladder state, the rotating center of the hinge mechanism 30 is disposed between the left ladder rack 10 and the right ladder rack 20, and the height of the rotating center of the hinge mechanism 30 is disposed between the highest point and the lowest point of the footboard at the top portion of the herringbone ladder (if the left footboard 14 is higher than the right footboard 24, the rotating center is between the highest point and the lowest point of the top left footboard 14; if the right footboard 24 is higher than the left footboard 14, the rotating center is between the highest point and the lowest point of the top right footboard 24, as figured in FIG. 6 and FIG. 7); in the straight ladder state by rotating, the left ladder rack 10 is in line with the right ladder rack 20, the distance between the left footboard 14 at the top portion of the left ladder rack 10 and the right footboard 24 at the top portion of the right ladder rack 20 is defined L3; therein L1=L2=L3. Therefore, the distance of each step is equal in the straight ladder state and the herringbone ladder state.

The distance between the left footboard at the bottom portion of the left ladder rack 14 and the bottom end face of the left leg 12 is defined L4, therein L4=L1; the distance between the right footboard 24 at the bottom portion of the right ladder rack 22 and the bottom end face of the right leg is defined L5, therein L5=L2. Therefore, the user can keep the same distance of step from the initial.

The thickness of the left footboard 14 is equal to the thickness of the right footboard 24, there are five right footboards 24 and four left footboards 14, the right footboards 24 have one more than the left footboards 14, the right leg 22 is one thickness of footboard longer than the left leg 12. It can be understood that, if the left footboards have one more than the right footboards, the left leg is one thickness of footboard longer than the right leg.

Figure 1:
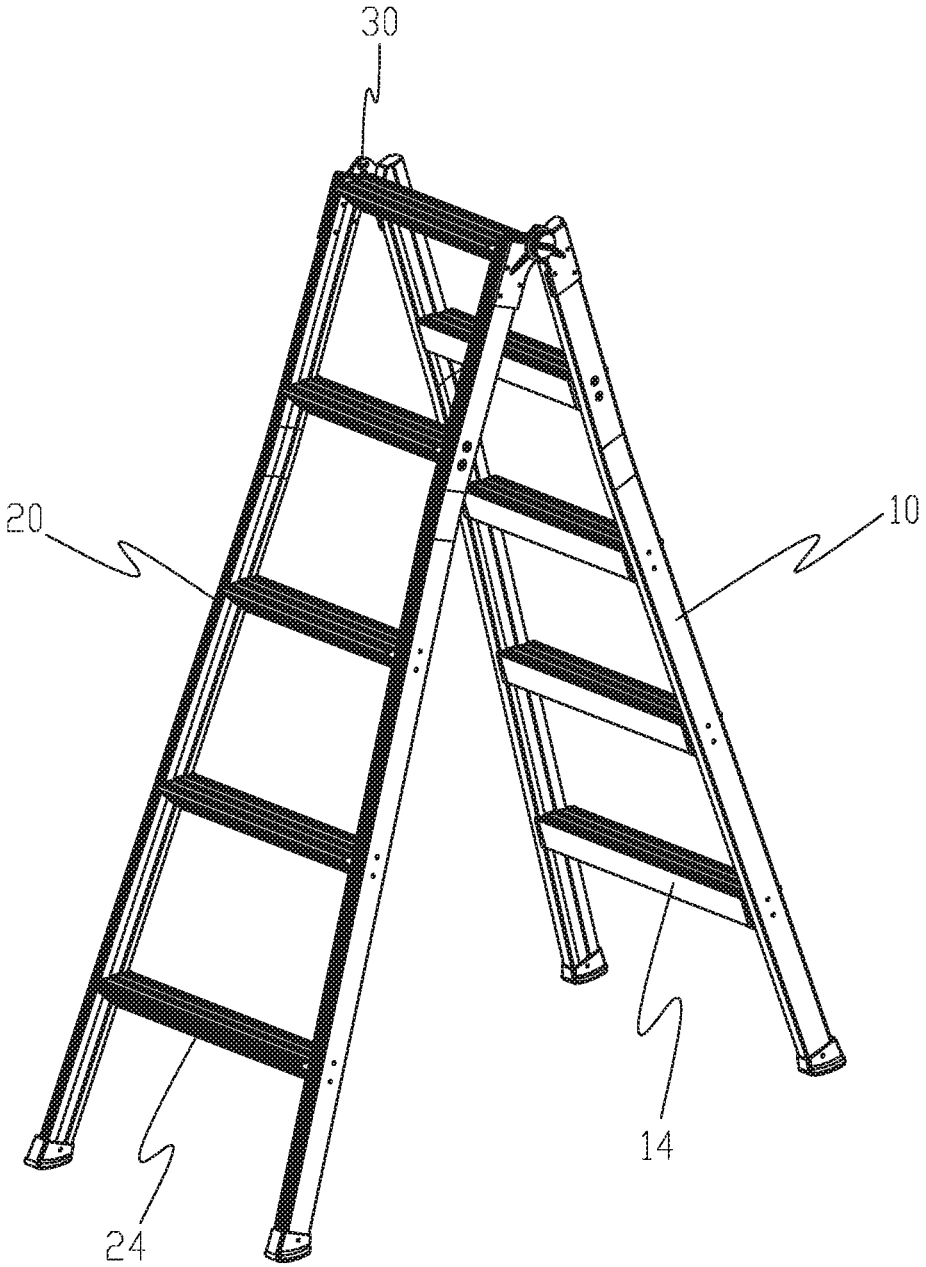
FIG. 1 illustrates a schematic diagram of the deformable herringbone ladder with straight ladder function which can be changed to a straight ladder of the present invention in the herringbone ladder state.
Figure 2A:
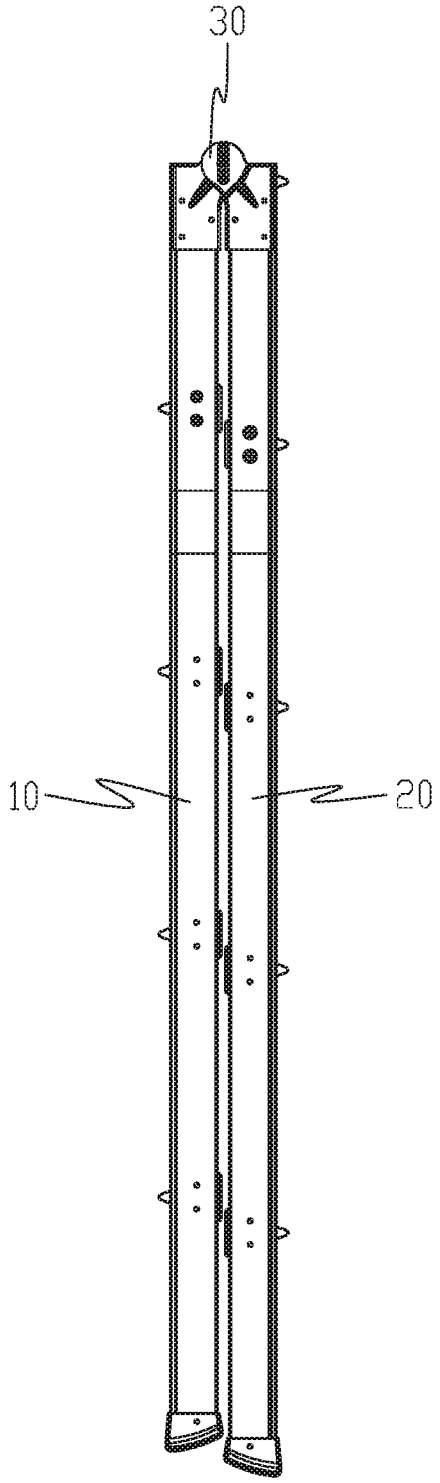
FIGS. 2*a* and 2*b* illustrate a side view and a schematic diagram of the herringbone ladder of FIG. 1 in folding state.
Figure 2B:
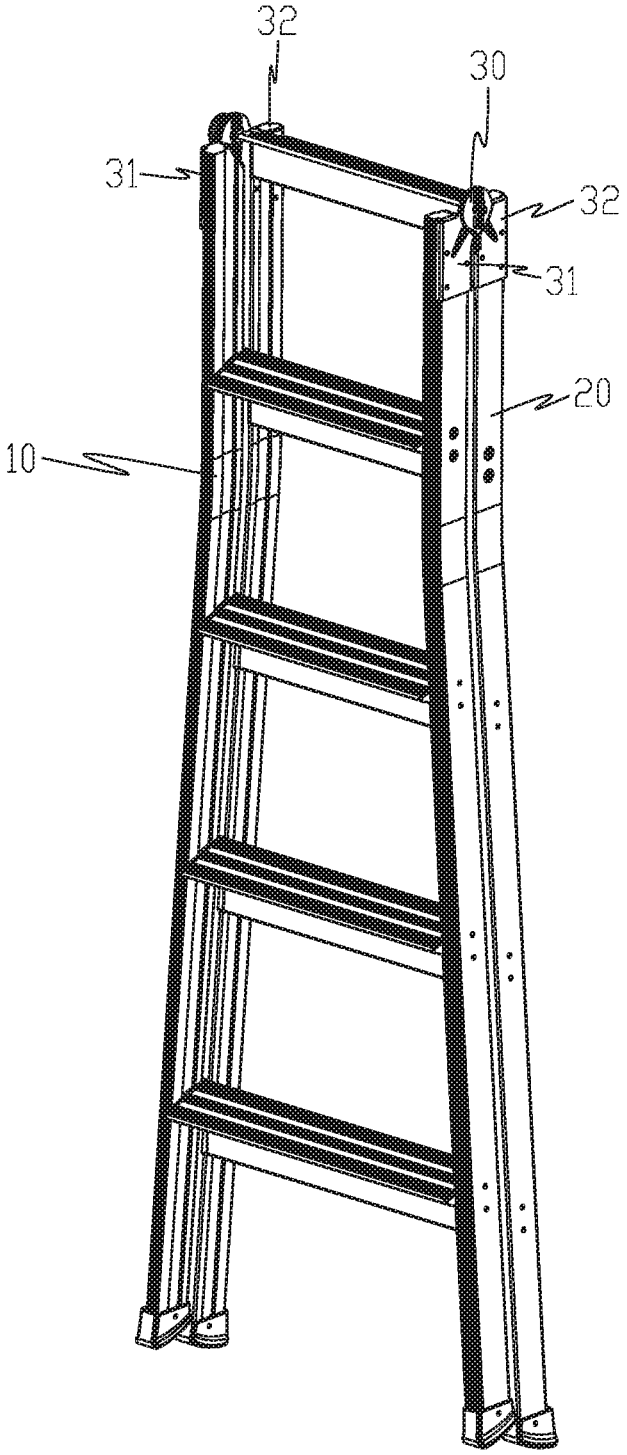
Figure 3A:
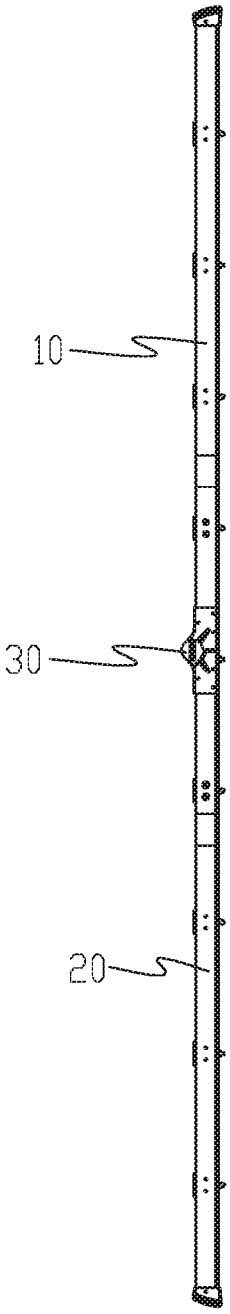
FIGS. 3*a* and 3*b* illustrates a side view and a schematic diagram of the herringbone ladder of FIG. 1 in straight ladder state.
Figure 3B:
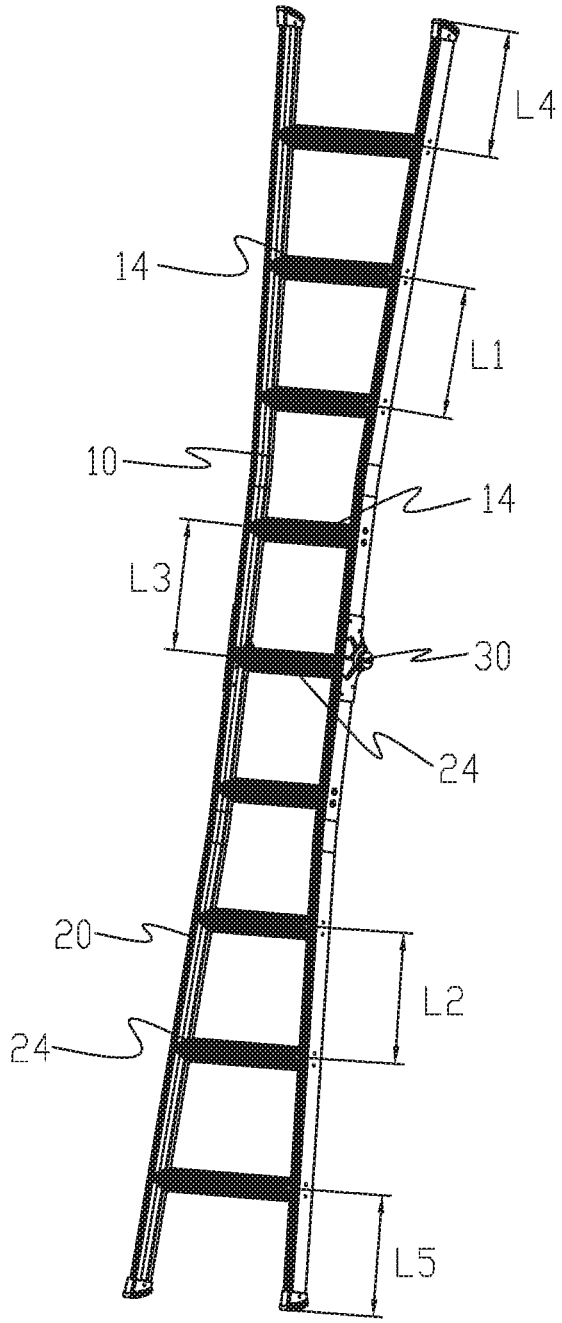
Figure 4:
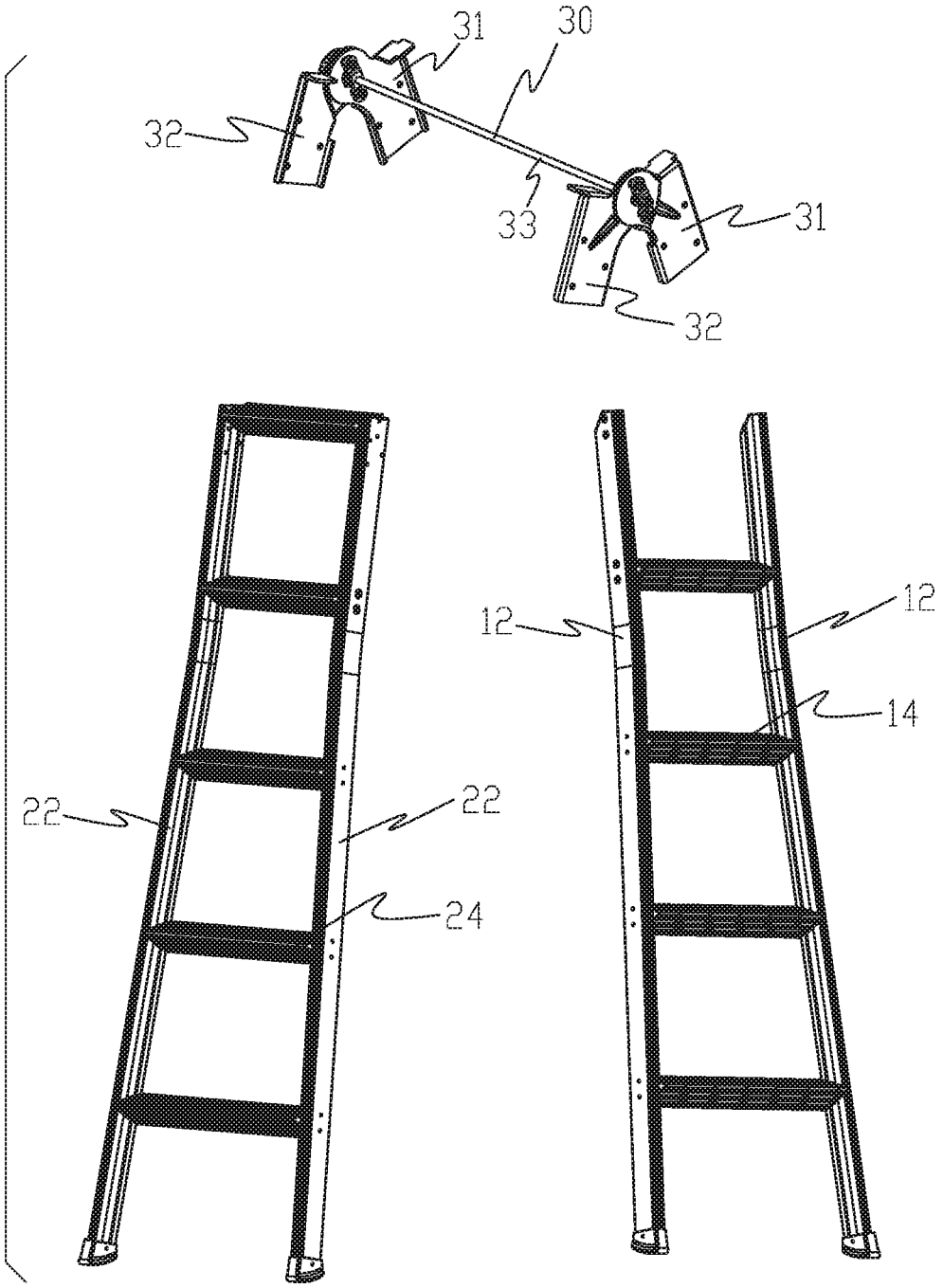
FIG. 4 illustrates an exploded diagram of the herringbone ladder of FIG. 1.
Figure 5:
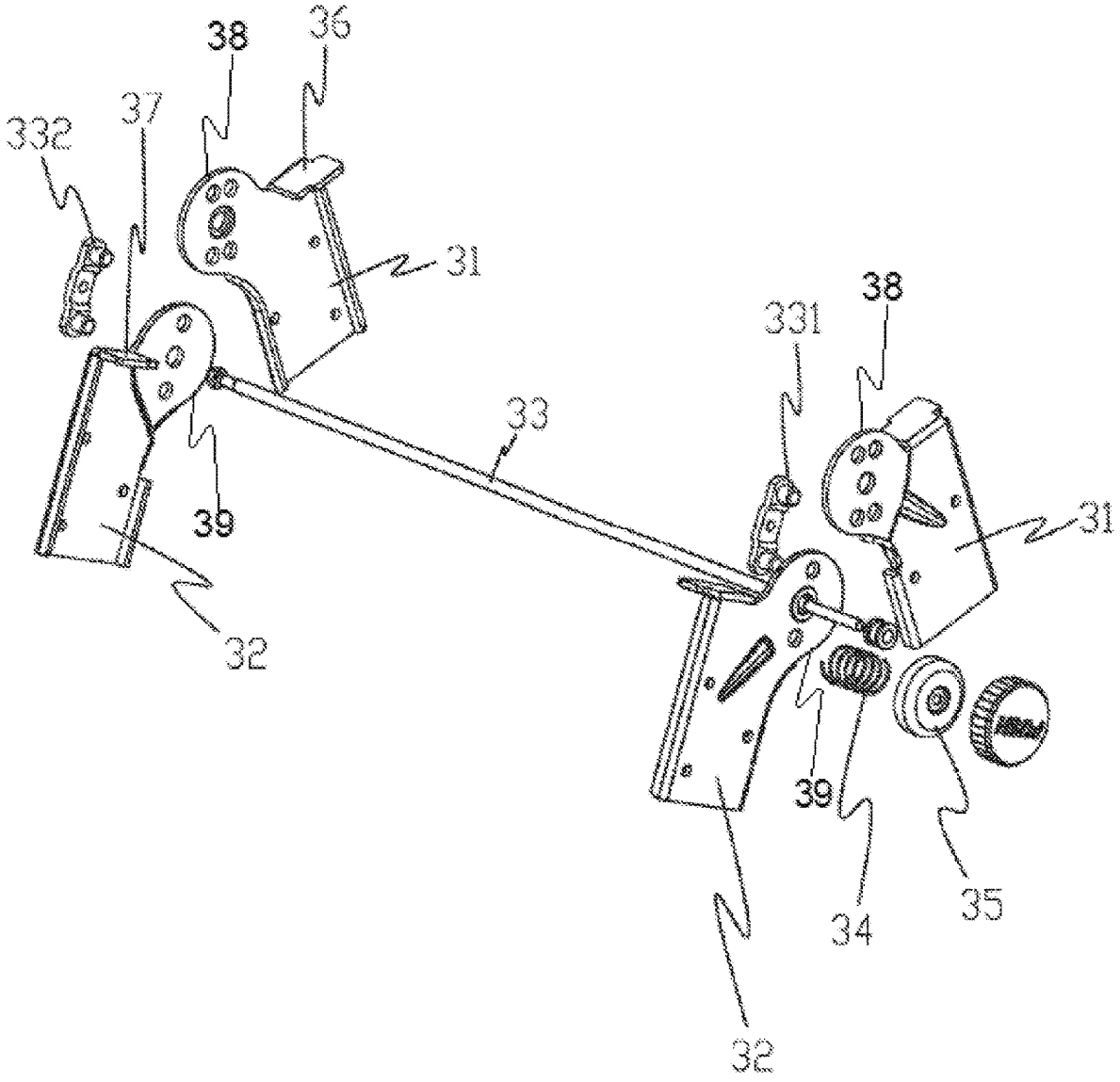
FIG. 5 illustrates an exploded diagram of the hinge of the herringbone ladder of FIG. 1.

Referring to FIGS. 4-6, the hinge mechanism 30 comprises two left rotating sheets 31 respectively connected to the top portion of the two left legs 12 and two right rotating sheets 32 respectively connected to the top portion of the two right legs 22. An upper portion of each of the two left rotating sheets 31 extends in a direction of the right ladder rack 20 to define a first extended portion 38. An upper portion of each of the two right rotating sheets 32 extends in a direction of the left ladder rack 10 to define a second extended portion 39. The hinge mechanism 30 also comprises a rotating shaft 33 passing through the two left rotating sheets and the two right rotating sheets. The left rotating sheets 31 are rotatable about the rotating shaft 33, and the right rotating sheets 32 are rotatable about the rotating shaft 33. The axis of the rotating shaft 33 is the rotating center of the hinge mechanism 30.

The front end portion of the rotating shaft 33 is disposed with a front insert pin 331, and the rear end portion of the rotating shaft 33 is disposed with a rear insert pin 332. In folded, herringbone ladder or straight ladder state, the front insert pin 331 is inserted into a corresponding one of first extended portions 38 and a corresponding one of the second extended portions 39 to restrict the relative rotation of the left rotating sheet 31 and the right rotating sheet 32, and the rear insert pin 332 is inserted into another one of first extended portions 38 and another one of the second extended portions 39 to restrict the relative rotation of the other left rotating sheet 31 and the other right rotating sheet 32. The rotating shaft 33 is axially movable to release the restriction on the left rotating sheets 31 and the right rotating sheets 32.

The hinge mechanism 30 further comprises an elastic spring 34, the elastic spring 34 acts an axial elastic force on the rotating shaft 33 to make the rotating shaft 33 axially move to drive the front and rear insert pin 331 and 332 to insert to the left and right rotating sheets 31 and 32. One end of the rotating shaft 33 is connected with an end cap 35, the elastic spring 34 is sleeved on the rotating shaft 33 and abuts against the end cap 35.

The end cap 35 can be pressed down by overcoming the elastic force of the spring 34 to drive the rotating shaft 33 to move to make the front insert pin 331 and the rear insert pin 332 respectively release the restrictions on the left rotating sheet 31 and the right rotating sheets 32, then the left ladder rack 10 and the right ladder rack 20 are rotatable.

The left rotating sheet 31 and the right connecting sheet 32 are contacted together, the side edge of the left rotating sheet 31 is connected with a flat board 36, the side edge of the right rotating sheet 32 is connected with a flat board 37, the flat board 36 of the left rotating sheet 31 and the flat board 37 of the right rotating sheet 32 are stacked together in straight ladder state.

A footboard 24 at a top portion of the right ladder rack 20 is disposed with a hem structure 242 to cover a top side of the rotating shaft 33. In another case, if a number of left footboards 14 is one more than a number of right footboards 24, the hem structure 242 is disposed at the left footboard 14 at the top portion of the left ladder rack 10; or a groove 244 is disposed at the side wall of the left footboard 14 at the top portion of the left ladder rack 10.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A switchable ladder, comprising:

a first ladder rack, a second ladder rack, a hinge mechanism, a front insert pin, a rear insert pin, and a rotating shaft, wherein:

a top portion of the first ladder rack is connected to a top portion of the second ladder rack by the hinge mechanism, the first ladder rack and the second ladder rack are relatively rotatable to switch the switchable ladder between a step ladder state and a straight ladder state, the first ladder rack comprises two first legs and an even number of first footboards connecting the two first legs, the even number of first footboards are arranged in parallel at equal intervals, a first distance between two adjacent footboards of the even number of first footboards is defined as L1, the second ladder rack comprises two second legs and an odd number of second footboards connecting the two second legs, the odd number of second footboards are arranged in parallel at equal intervals, a second distance between two adjacent footboards of the odd number of second footboards is defined as L2, the hinge mechanism comprises two first rotating sheets and two second rotating sheets, the two first rotating sheets are respectively connected to a top portion of each of the two first legs, the top portion of each of the two first legs together define the top portion of the first ladder rack, the two second rotating sheets are respectively connected to a top portion of each of the two second legs, the top portion of each of the two second legs together define the top portion of the second ladder rack, a lower portion of each of the two first rotating sheets is disposed on a corresponding one of two outer sides of the first ladder rack, an upper portion of each of the two first rotating sheets extends in a direction of the second ladder rack to define a first extended portion, a lower portion of each of the two second rotating sheets is disposed on a corresponding one of two outer sides of the second ladder rack, an upper portion of each of the two second rotating sheets extends in a direction of the first ladder rack to define a second extended portion, when the switchable ladder is in the step ladder state:

a rotating center of the hinge mechanism is disposed between the first ladder rack and the second ladder rack, a height of the rotating center of the hinge mechanism is disposed between a highest point and a lowest point of an uppermost footboard of the even number of first footboards at a top portion of the switchable ladder or between a highest point and a lowest point of an uppermost footboard of the odd number of second footboards at the top portion of the switchable ladder, and the front insert pin and the rear insert pin are respectively inserted into a corresponding one of the two first extended portions and a corresponding one of the two second extended portions to restrict a relative rotation of the corresponding one of the two first rotating sheets and the corresponding one of the two second rotating sheets, when the switchable ladder is in the straight ladder state:

the first ladder rack is in line with the second ladder rack, a third distance between the uppermost footboard of the even number of first footboards and the uppermost footboard of the odd number of second footboards is defined as L3, the front insert pin and the rear insert pin are respectively inserted into the corresponding one of the two first extended portions and the corresponding one of the two second extended portions to restrict the relative rotation of the corresponding one of the two first rotating sheets and the corresponding one of the two second rotating sheets, and the top portion of each of the two first legs abuts the top portion of a corresponding one of the two second legs, wherein L1=L2=L3, and the uppermost footboard of the even number of first footboards or the uppermost footboard of the odd number of second footboards is disposed with a hem structure to cover a top side of the rotating shaft.

2. The switchable ladder according to claim 1, wherein:

a fourth distance between a lowest footboard of the even number of first footboards and a bottom end of the first ladder rack is defined as L4,

L4=L1, a fifth distance between a lowest footboard of the odd number of second footboards and a bottom end of the second ladder rack is defined L5, and

L5=L2.

3. The switchable ladder according to claim 2, wherein:

a thickness of each of the even number of first footboards is equal to a thickness of each of the odd number of second footboards, the even number of first footboards have one more footboard than the odd number of second footboards, and a length of each of the two first legs is longer than a length of each of the two second legs by an amount equal to the thickness of one footboard of the even number of first footboards.

4. The switchable ladder according to claim 2, wherein:

a thickness of each of the even number of first footboards is equal to a thickness of each of the odd number of second footboards, the odd number of second footboards have one more footboard than the even number of first footboards, and a length of each of the two second legs is longer than a length of each of the two first legs by an amount equal to the thickness of one footboard of the odd number of second footboards.

5. The switchable ladder according to claim 1, wherein:

the rotating shaft passes through the two first rotating sheets and the two second rotating sheets, each of the two first rotating sheets is rotatable about the rotating shaft, and each of the two second rotating sheets is rotatable about the rotating shaft.

6. The switchable ladder according to claim 5, wherein:

a front end portion of the rotating shaft is disposed with the front insert pin, a rear end portion of the rotating shaft is disposed with the rear insert pin, and when the switchable ladder is in a folded state:

the front insert pin and the rear insert pin are respectively inserted into the corresponding one of the two first extended portions and the corresponding one of the two second extended portions to restrict the relative rotation of the corresponding one of the two first rotating sheets and the corresponding one of the two second rotating sheets, and the rotating shaft is axially movable to release a restriction of the front insert pin and the rear insert pin applied on the corresponding one of the two first rotating sheets and the corresponding one of the two second rotating sheets.

7. The switchable ladder according to claim 6, wherein:

the hinge mechanism further comprises an elastic spring, and the elastic spring acts as an axial elastic force on the rotating shaft to make the rotating shaft axially move to drive the front insert pin and the rear insert pin to insert into the corresponding one of the two first rotating sheets and the corresponding one of the two second rotating sheets.

8. The switchable ladder according to claim 7, wherein:

a front end of the rotating shaft is connected with an end cap, and the elastic spring is surrounds a portion of the rotating shaft and abuts the end cap.

9. The switchable ladder according to claim 1, wherein:

each of the two first rotating sheets and a corresponding one of the second rotating sheets are connected together, a side edge of each of the first rotating sheets is connected with a first flat board, a side edge of each of the second rotating sheets is connected with a second flat board, and when the switchable ladder is in the straight ladder state the first flat board and a corresponding one of the second flat boards are stacked together.

10. The switchable ladder according to claim 1, wherein: the front insert pin and the rear insert pin are disposed at the same side of the switchable ladder.

11. The switchable ladder according to claim 10, wherein the rotating shaft is disposed within a hole defined by the front insert pin and a hole defined by the rear insert pin.

12. The switchable ladder according to claim 1, wherein: the rotating shaft is disposed within a hole defined by the front insert pin and a hole defined by the rear insert pin: the front insert pin is disposed between a first rotating sheet of the two first rotating sheets and a second rotating sheet of the two first rotating sheets, and the second rotating sheet of the two first rotating sheets is disposed between the front insert pin and the rear insert pin.

13. The switchable ladder according to claim 12, wherein: the front insert pin is disposed between a first rotating sheet of the two second rotating sheets and a second rotating sheet of the two second rotating sheets, and the second rotating sheet of the two second rotating sheets is disposed between the front insert pin and the rear insert pin.

14. The switchable ladder according to claim 12, comprising:

an elastic spring, wherein the first rotating sheet of the two first rotating sheets is disposed between the elastic spring and the front insert pin.

15. The switchable ladder according to claim 14, wherein:

a first rotating sheet of the two second rotating sheets is disposed between the elastic spring and the front insert pin.

16. The switchable ladder of claim 14, comprising:

an end cap, wherein the elastic spring is disposed between the end cap and the first rotating sheet of the two first rotating sheets.

17. The switchable ladder of claim 12, wherein the rotating shaft extends continuously from the front insert pin to the rear insert pin.

* * * * *